US005168701A

United States Patent [19]

Yamamoto et al.

[11] Patent Number: 5,168,701

[45] Date of Patent: Dec. 8, 1992

[54] METHOD OF CONTROLLING THE AIR-FUEL RATIO IN AN INTERNAL COMBUSTION ENGINE

[75] Inventors: Toshio Yamamoto; Katsuyuki Kajitani; Youichi Iwakura, all of Osaka, Japan

[73] Assignee: Daihatsu Motor Co., Ltd., Osaka, Japan

[21] Appl. No.: 674,162

[22] Filed: Mar. 25, 1991

[30] Foreign Application Priority Data

Apr. 3, 1990 [JP] Japan ..... 2-89590
Apr. 3, 1990 [JP] Japan ..... 2-89593

[51] Int. Cl.[5] ..... F01N 3/20

[52] U.S. Cl. ..... 60/274; 60/276; 60/285; 123/674; 123/691

[58] Field of Search ..... 60/274, 276, 285; 123/691, 674

[56] References Cited

U.S. PATENT DOCUMENTS

| | | | |
|---|---|---|---|
| 4,251,989 | 2/1981 | Norimatsu et al. . | |
| 4,707,985 | 11/1987 | Nagai | 60/276 |
| 4,712,373 | 12/1987 | Nagai et al. . | |
| 4,720,973 | 1/1988 | Katsuno | 60/276 |
| 4,761,950 | 8/1988 | Nagai | 123/691 |
| 4,831,838 | 5/1989 | Nagai | 60/276 |
| 4,854,124 | 8/1989 | Tamura | 60/276 |
| 4,901,240 | 2/1990 | Schmidt | 123/674 |

*Primary Examiner*—Douglas Hart
*Attorney, Agent, or Firm*—Wegner, Cantor, Mueller & Player

[57] ABSTRACT

This invention relates to a method of controlling the air-fuel ratio of an internal combustion engine having a main $0_2$ sensor and a subsidiary $0_2$ sensor provided upstream and downstream, respectively, of a catalyst converter for detecting the oxygen concentration of the exhaust gas of the engine. The method comprises: feedback-controlling the air-fuel ratio of a mixture gas to be supplied to the engine to about a stoichiometric air-fuel ratio having the highest purification efficiency of the exhaust gas by adjusting the amount of fuel to be supplied by an injector in accordance with the output signal from the main $0_2$ sensor; and also feedback-controlling more precisely the air-fuel ratio of the mixture gas to about the stoichiometric air-fuel ratio by adjusting the amount of fuel supply in accordance with the output signal of the subsidiary $0_2$ sensor. The feedback control value set for adjusting the amount of fuel supply in accordance with the output signal of the subsidiary $0_2$ sensor is usually increased or decreased by a predetermined value. When a change of the air-fuel ratio from the rich to the lean side or from the lean to the rich side is detected by the output signal of the subsidiary $0_2$ sensor, the feedback control value is increased or decreased by a skip amount.

5 Claims, 11 Drawing Sheets

METHOD OF CONTROLLING THE AIR-FUEL RATIO IN AN INTERNAL COMBUSTION ENGINE

BACKGROUND OF THE INVENTION

This invention relates to a method of controlling the air-fuel ratio in an internal combustion engine of an automobile or the like provided with an $O_2$ sensor at both the upstream and downstream sides of a catalyst converter for purifying the exhaust gas.

In an internal combustion engine so arranged as to supply fuel to the intake passage of the engine through an injector controlled by an electronic control device, the amount of fuel supplied in each cycle of the engine is generally determined in the following manner. The injector is provided with a solenoid valve. When a fuel injection signal (pulse voltage) is applied to the electromagnetic coil of the valve by the electronic control device, fuel is injected through a nozzle in an amount corresponding to the time width of the applied signal. The electronic control device determines first a basic injection time period in accordance with the intake air pressure, the engine speed, or the intake air amount detected by an air flowmeter or the like device, and then corrects the basic injection time period by various correction coefficients determined in accordance with the engine conditions, thereby to determine a current injection time period. The control device then applies a pulse signal of a time width corresponding to the current fuel injection time period to the fuel injector at a predetermined injection time, thereby to supply a proper amount of fuel to the engine.

The three-way catalyst of a catalyst converter provided in the exhaust system of an engine can most effectively oxidize and reduce CO, HC and NOx contained in the exhaust gas, if the air-fuel ratio of the mixture gas is maintained within a narrow range about the stoichiometric air-fuel ratio. The stoichiometric air-fuel ratio means the air-fuel ratio of a mixture gas which contains the exact amount of oxygen required to make the fuel contained in the mixture gas combust perfectly. In the case of gasoline the stoichiometric air-fuel ratio is usually between about 14.4 and 15. A mixture gas or the air-fuel ratio thereof is said to be "lean" if the ratio is higher than the stoichiometric value, and "rich" if it is lower than the stoichiometric value.

An $O_2$ sensor for detecting the oxygen concentration of the exhaust gas is provided near the inlet port of the catalyst converter. The $O_2$ sensor is so designed as to generate a low voltage when the air-fuel ratio of the mixture gas is lean and the oxygen concentration of the exhaust gas is high, and a high voltage when the air-fuel ratio of the mixture gas is rich and the oxygen concentration of the exhaust gas is low. The $O_2$ sensor has a characteristic that its output voltage changes drastically about the stoichiometric air-fuel ratio.

In an engine provided with the above-mentioned device, the air-fuel ratio of the mixture gas is adjusted to about the stoichiometric value in the following manner. The electronic control device has an air-fuel ratio feedback correction coefficient set therein beforehand. The basic injection time period is multiplied by the coefficient, which is changed about 1 (one) in accordance with the output voltage of the $O_2$ sensor. When the electronic control device has detected by the output voltage of the $O_2$ sensor a change of the air-fuel ratio of the mixture gas from the lean side of the stoichiometric ratio to the rich side thereof, the device reduces the air-fuel ratio feedback correction coefficient skippingly by a predetermined relatively large amount at first and then gradually by a minute amount. As a result, since the fuel injection amount decreases, the air-fuel ratio of the mixture gas changes from the rich side toward the stoichiometric ratio. When the electronic control device detects a change of the air-fuel ratio of the mixture gas from the rich side to the lean side by the output voltage of the $O_2$ sensor, the device increases the air-fuel ratio feedback correction coefficient skippingly by a relatively large amount at first and then gradually by a minute amount. As a result, since the fuel injection amount increases, the air-fuel ratio of the mixture gas changes from the lean side to the stoichiometric value. By repeating the feedback control operation the air-fuel ratio of the mixture gas approaches the stoichiometric level thereby to effectively purify the exhaust gas by the three-way catalyst.

With a single $O_2$ sensor, however, a required air-fuel ratio feedback control may not be effected because of adverse influences by deterioration of the ability of the $O_2$ sensor caused by aging or differences in the output characteristics between different $O_2$ sensors or differences in the fuel injection amount between the injectors of different cylinders of the engine, so that the air-fuel ratio is likely to be deviated from near the stoichiometric value. If the catalyst converter is connected to the concentration portion of an exhaust manifold in order to make the three-way catalyst attain an activating temperature as soon as possible so as to purify the exhaust gas, then the $O_2$ sensor is disposed at the concentration portion of the exhaust mainfold. In this arrangement the output voltage of the $O_2$ sensor may be influenced by the exhaust gas from a particular one of the cylinders, or deterioration of the $O_2$ sensor may be accelerated by hot exhaust gas.

To overcome the above defects, it has been proposed in the prior art to provide a second $O_2$ sensor at the downstream side of the catalyst converter in addition to the above-mentioned first $O_2$ sensor, so that the feedback control of the air-fuel ratio may be conducted by the output voltage of both $O_2$ sensors (See U.S. Pat. Nos. 4,251,989 and 4,712,373). In the proposed arrangement of the prior art, the electronic control device has set therein a feedback control value which is changed in accordance with the output voltage of the second $O_2$ sensor, and the above-mentioned basic injection time period is directly or indirectly corrected by the feedback control value. The fuel injection amount increases as the feedback control value increases and decreases as the value decreases. At the downstream side of the catalyst converter, the exhaust gas from all the cylinders of the engine is in a well-stirred condition, and the oxygen concentration of the exhaust gas is substantially in an equilibrium state by the function of the three-way catalyst. As a result, the output voltage of the second $O_2$ sensor changes more slowly than that of the first $O_2$ sensor. In particular, in case the mixture gas adjusted on the basis of the output voltage of the first $O_2$ sensor is totally at the rich side, the output voltage of the second $O_2$ sensor remains rich for a long time. On the contrary, in case the total mixture gas is at the lean side, the output voltage of the second $O_2$ sensor remains lean for a long time. As mentioned above, while feedback control of the air-fuel ratio is being conducted by using the signal from the first $O_2$ sensor, the air-fuel ratio of the mixture gas as a whole is detected by the signal from the second $O_2$ sensor, and in accordance with the result of the detection the feedback control value is changed by a predetermined value at every predetermined gating time. In this manner the air-fuel ratio of the mixture gas can be accurately adjusted approximately to the stoichiometric value, and the exhaust gas can be effectively purified by the three-way catalyst.

In the above-mentioned control, however, the time interval at which the air-fuel ratio is controlled by the output voltage of the second $O_2$ sensor is several times longer than the time interval at which the air-fuel ratio is controlled by the output voltage of the first $O_2$ sensor. Therefore, if the above-mentioned feedback control value is gradually increased or decreased by a predetermined value when the air-fuel ratio of the mixture gas has changed from the rich to the lean side or from the lean to the rich side, the fuel supply amount can not be adjusted quickly. This poses a problem that the time period during which the total mixture gas is rich or lean can not be shortened, with resulting difficulty in improving the efficiency of purification of the exhaust gas.

SUMMARY OF THE INVENTION

The primary object of the invention is to cause the air-fuel ratio to quickly approach the stoichiometric level in feedback control of the air-fuel ratio by using the output voltage of the above-mentioned second $O_2$ sensor.

Another object of the invention is to cause the air-fuel ratio to quickly approach the stoichiometeric level in the above-mentioned feedback control even when the operating condition of the engine is abruptly changed.

In accordance with the invention, the primary object is attained in the following manner. In feedback control of the air-fuel ratio of a mixture gas to the stoichiometeric ratio by using the output voltages of the first and second $O_2$ sensors, if a rich air-fuel ratio is detected by the output voltage of the second $O_2$ sensor, the previously mentioned feedback control value is skippingly decreased upon arrival of a gating time. On the other hand, if a lean air-fuel ratio is detected by the output voltage of the second $O_2$ sensor, the feedback control value is skippingly increased upon arrival of a gating time. With this arrangement, by changing the feedback control amount by a skip amount it is possible to increase or decrease the fuel injection amount more quickly than in the conventional manner, thereby to shorten the time period for which the total mixture gas remains rich or lean. Therefore, while a feedback control of the air-fuel ratio is being conducted, the time period for which the air-fuel ratio of the mixture gas is near the stoichiometeric value becomes longer, so that the efficiency of purification of the exhaust gas can be kept at a high level.

In accordance with another aspect of the invention, when at least a lean air-fuel ratio is detected by the output voltage of the second $O_2$ sensor in the above-mentioned feedback control, the above-mentioned feedback control value is immediately increased by a skip amount even before a gating time is reached. Additionally, when a rich air-fuel ratio is detected by the output voltage of the second $O_2$ sensor, the feedback control value may be immediately decreased by a skip amount even before a gating time is reached. In this manner, even before a gating time is reached at predetermined regular intervals, when the air-fuel ratio of the total mixture gas has changed from the rich to the lean side or from the lean to the rich side, it is possible to increase or decrease the fuel injection amount in accordance with the skip amount of the feedback control value more quickly than in the conventional manner. As a result, not only the time period for which the mixture gas remains rich or lean can be shortened, but also the time period for which the air-fuel ratio of the mixture gas is maintained near the stoichiometric level can be made longer, thereby to maintain the efficiency of purification of the exhaust gas at a high level.

The time period for which the mixture gas remains rich will be referred to as the rich time (period) R, and the time period for which the mixture gas remains lean, as the lean time (period) L.

To attain the second object of the invention, a plurality of learning zones are provided for different load conditions of the engine in a feedback control of the air-fuel ratio to the stoichiometric level by using two $O_2$ sensors. A feedback control of the air-fuel ratio is conducted in each of the learning zones and a learning value of the feedback control value is stored, so that when a change of the engine load is detected, a feedback control is immediately conducted by the second $O_2$ sensor in accordance with the stored learning value for the changed engine load. With this arrangement, even if the engine load frequently fluctuates during feedback control of the air-fuel ratio, it is possible to effectively prevent the air-fuel ratio of the mixture gas from deviating from the stoichiometric ratio under transient condition, thereby to improve the efficiency of purification of the exhaust gas under transient condition.

In accordance with another embodiment of the invention for attaining the second object of the invention, for obtaining a learning value of the feedback control value in each of the learning zones set for different engine loads, normally a high (or relative maximum) value of the feedback control value when it changes from increasing to decreasing and a low (or relative minimum) value thereof when it changes from decreasing to increasing are used to calculate a learning value. At the initial stage immediately after the engine is started, however, it may happen that the engine load is shifted to a different learning zone without occurrence of either a high (or relative maximum) or a low (relative minimum) value, so that it is impossible to determine a learning value of the feedback control value in the learning zone to which the engine load belonged at the initial stage. Therefore, the system is so arranged that in a learning zone where there has occurred neither a high (relative maximum) nor a low (relative minimum) value of the feedback control value, a learning value is calculated from the (absolute) maximum value and the (absolute) minimum value of the feedback control value in that learning zone. If the feedback control value at the moment the engine load has changed is larger than the stored maximum value of the feedback control value before the engine load changes, the value at the moment the engine load has changed is stored as a new maximum value. On the other hand, if the feedback control value at the moment the engine load has changed is smaller than the stored minimum value of the feedback control value before the engine load changes, the value at the moment the load has changed is stored as a new minimum value.

By using the feedback control value under each of the engine loads in the above-mentioned manner it is always possible to determine a learning value in each of the learning zones. As a result, even if the engine load frequently fluctuates during feedback control of the air-fuel ratio, a feedback control can be immediately conducted by the second $O_2$ sensor in accordance with the learning value in each of the learning zones, so that it is possible to effectively prevent the air-fuel ratio of the mixture gas from deviating from the stoichiometric air-fuel ratio under transient condition, thereby to improve the purification efficiency of the exhaust gas.

DETAILED DESCRIPTION OF THE PREFERRED EMBODIMENTS

An embodiment of the invention will now be explained with reference to FIGS. 1 through 5.

Figure 1:
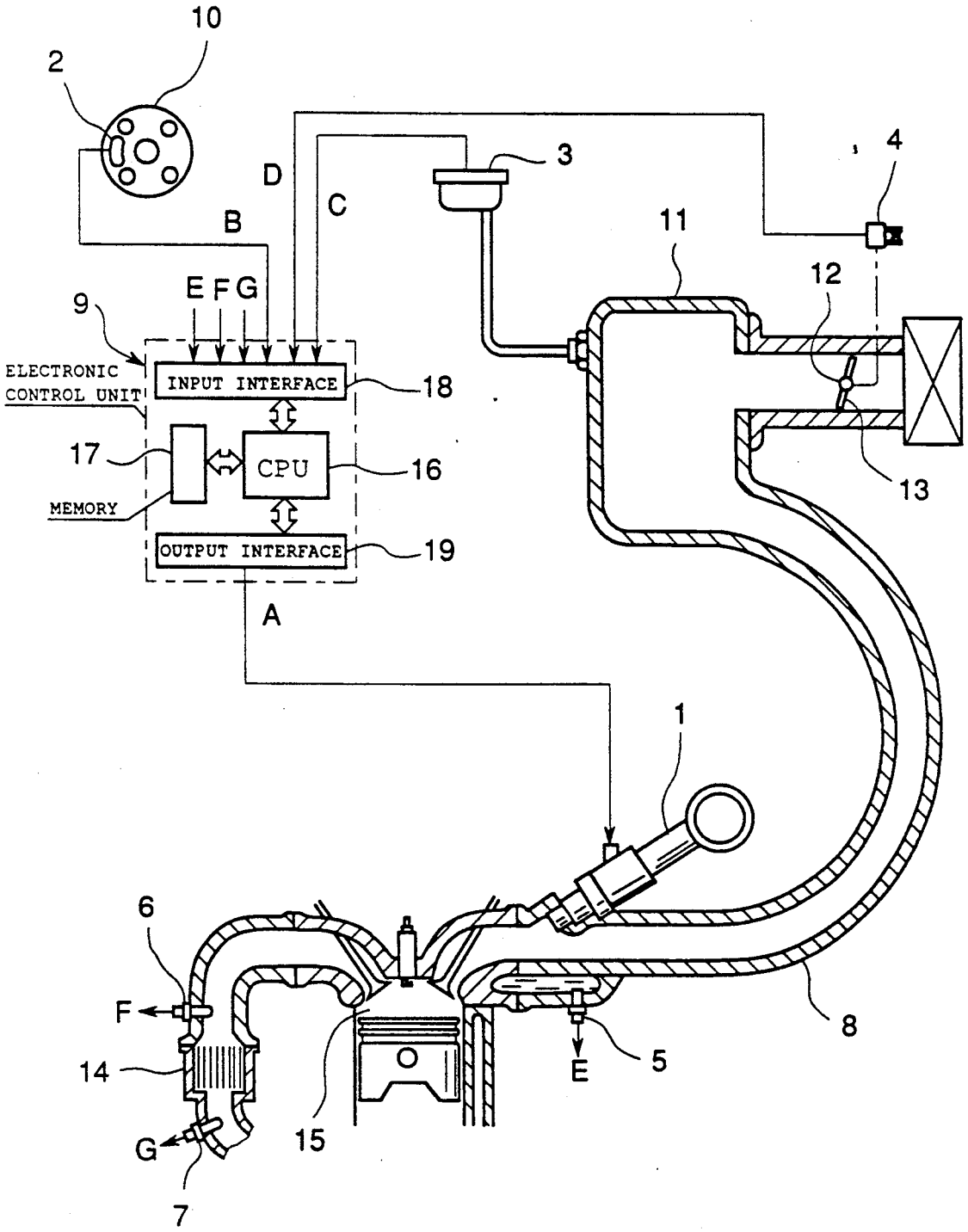
FIG. 1 is a schematic view of an engine in a first embodiment of the invention.

FIG. 1 schematically shows a part of an automobile engine. The engine has an injector 1, a crank angle sensor 2, a pressure sensor 3, and idle switch 4, a coolant temperature sensor 5, a main $O_2$ sensor 6 as the first $O_2$ sensor and a subsidiary $O_2$ sensor 7 as the second $O_2$ sensor.

The injector 1 is connected to an air intake passage 8 and contains an electromagnetic coil, etc. When an electronic control system 9 applies a fuel injection signal (pulse voltage) A to the electromagnetic coil, an amount of fuel corresponding to the time width of the applied signal is injected to the intake port of a cylinder.

The crank angle sensor 2 is enclosed in a distributor 10. The crank angle sensor 2 may comprise a signal rotor movable with the crank shaft (not shown) of the engine and an electromagnetic pick-up facing the outer peripheral surface of the signal rotor. When the signal rotor is rotated, the electromagnetic pick-up generates an engine revolution signal (pulse signal) B, by which the ignition time and the engine speed are detected. The engine speed may also be detected by the ignition signal produced in the ignition system.

The pressure sensor 3 is connected to a surge tank 11. The pressure sensor 3 is provided with a diaphragm made of an electrically conductive material the electrostatic capacity of which is changed by a pressure difference between the opposite sides thereof, and generates an intake air pressure signal (electric signal) C in proportion to the intake air pressure.

The idle switch 4 is connected to a throttle shaft 12. The idle switch is an on-off switch which takes an ON position to generate a throttle signal D while the throttle valve 13 is closed and an OFF position when the valve is opened.

The coolant temperature sensor 5 contains, for example, a thermister the electric resistance of which changes with the ambient temperature, and generates a coolant temperature signal E in accordance with the engine coolant temperature.

Figure 3:
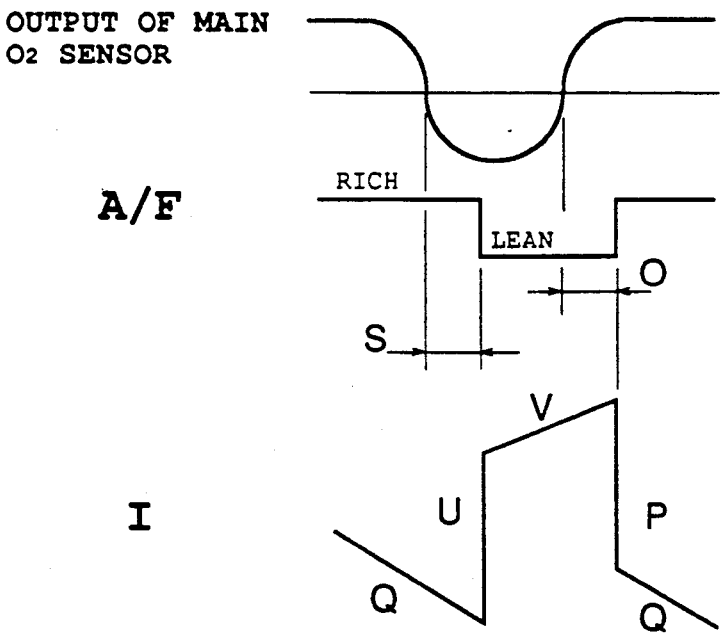
FIG. 3 is a timing chart showing a part of the control in accordance with the first embodiment of the invention.

The main $O_2$ sensor 6 is provided upstream of a manifold converter 14 which is a catalyst converter and generates a feedback signal (electric signal) F corresponding to the oxygen concentration in the exhaust gas. In particular, as shown in FIG. 3 the $O_2$ sensor 6 is so constructed as to generate a low voltage signal in case the air-fuel ratio A/F of the mixture gas is lean and the oxygen concentration of the exhaust gas is high, and a high voltage signal in case the air-fuel ratio A/F is rich and the oxygen concentration of the exhaust gas is low.

The subsidiary $O_2$ sensor 7 is of the same construction as the main $O_2$ sensor 6 and generates a feedback signal (electric signal) G corresponding to the oxygen concentration of the exhaust gas. In particular, the sensor 7 is so constructed as to generate a low voltage signal in case the air-fuel ratio of the mixture gas is lean and the oxygen concentration of the exhaust gas is high, and a high voltage signal in case the air-fuel ratio of the mixture gas is rich and the oxygen concentration of the exhaust gas is low.

The electronic control device 9 has a function to control the air-fuel ratio of the mixture gas to be supplied to a combustion chamber 15, and can be a microcomputer having a central processing unit 16, a memory 17, an input interface 18 and an output interface 19. The input interface 18 receives at least an engine speed signal B from the crank angle sensor 2, an intake air pressure signal C from the pressure sensor 3, a throttle signal D from the idle switch 4, a coolant temperature signal E from the coolant temperature sensor 5, a feedback signal F from the main $O_2$ sensor 6 and a feedback signal G from the subsidiary $O_2$ sensor 7. A fuel injection signal A is applied through the output interface 19 to the injector 1. The electronic control device 9 calculates an intake air amount by the engine speed signal B and the intake air pressure signal C, and determines a basic injection amount H in accordance with the calculated intake air amount. Then, the device corrects the basic injection amount H by the air-fuel ratio feedback correction coefficient I determined by the feedback signal F from the main $O_2$ sensor 6, the various correction coefficients J determined by the operating conditions of the engine and the invalid injection time K, and determines a final actuation time period T in accordance with the following expression thereby to cause the injector 1 to inject an amount of fuel corresponding to the time period T.

$T=H\times I\times J+K.$

Figure 2:
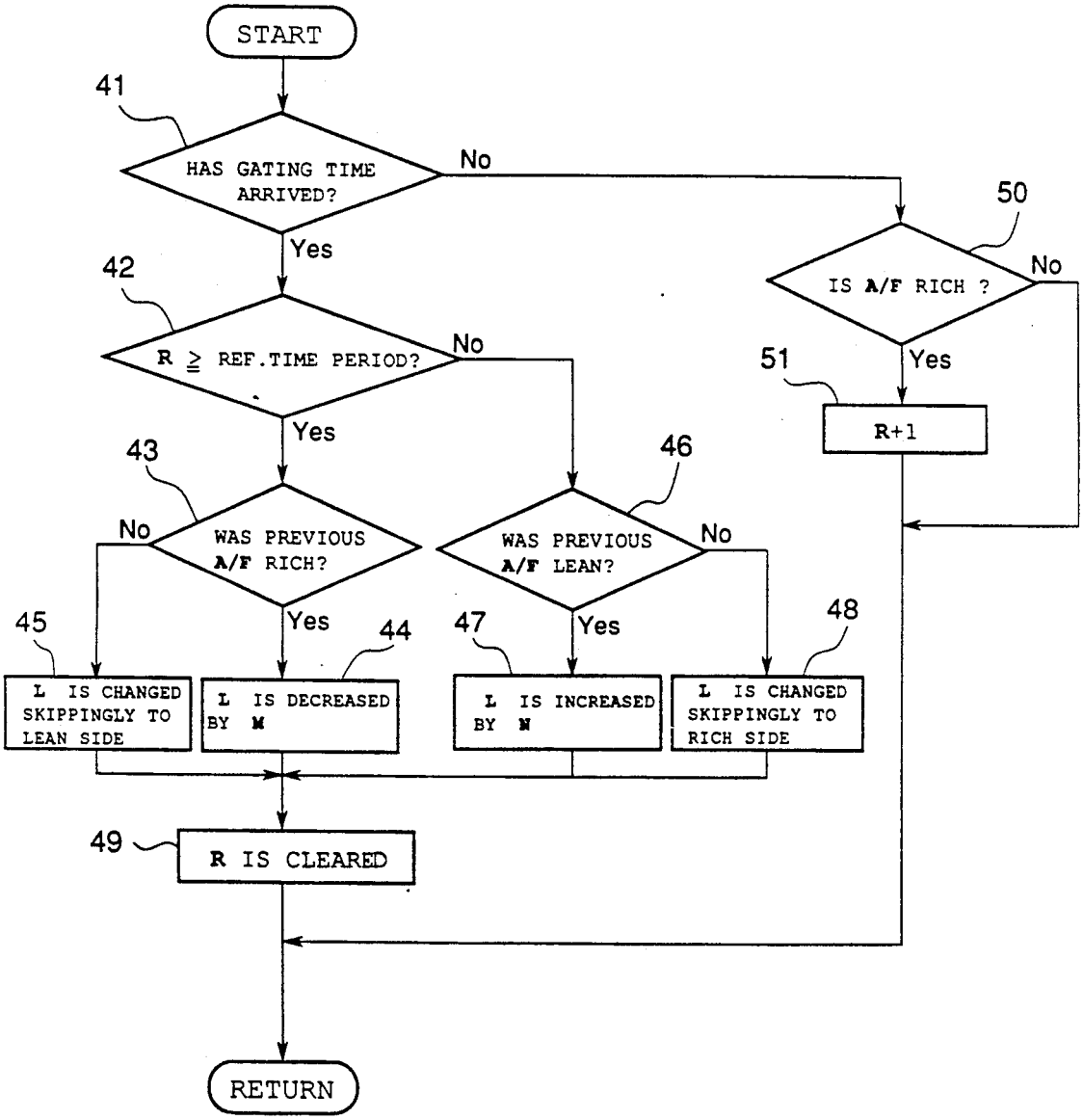
FIG. 2 is a flow chart showing the steps of the control in accordance with the first embodiment of the invention.
Figure 4:
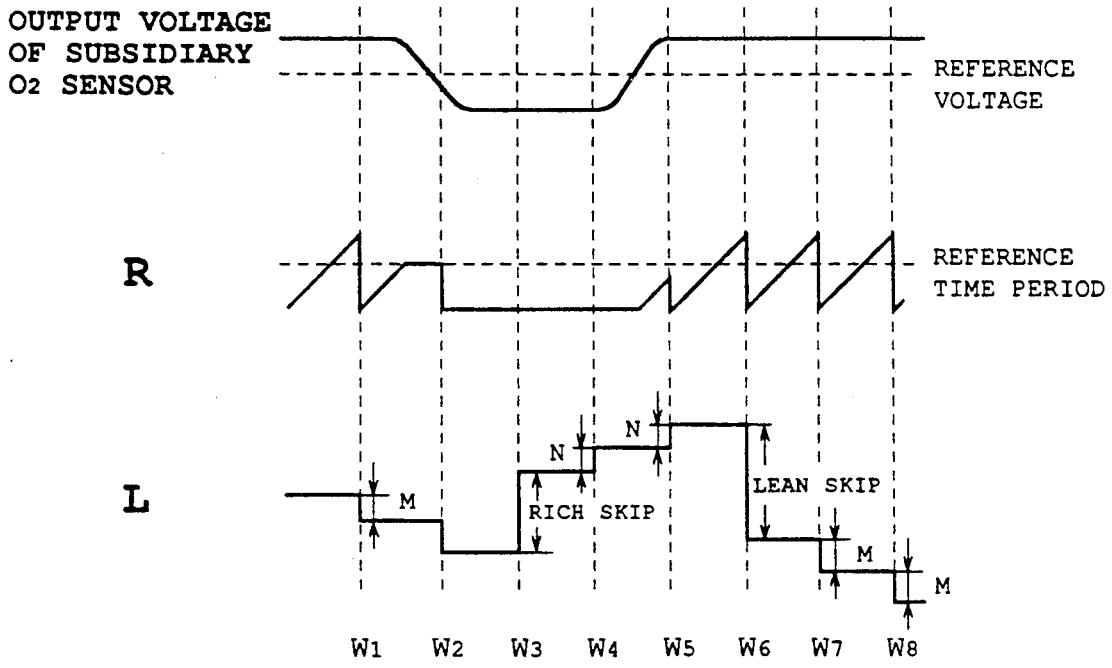
FIG. 4 is a timing chart showing a part of the control in accordance with the first embodiment of the invention.
Figure 5:
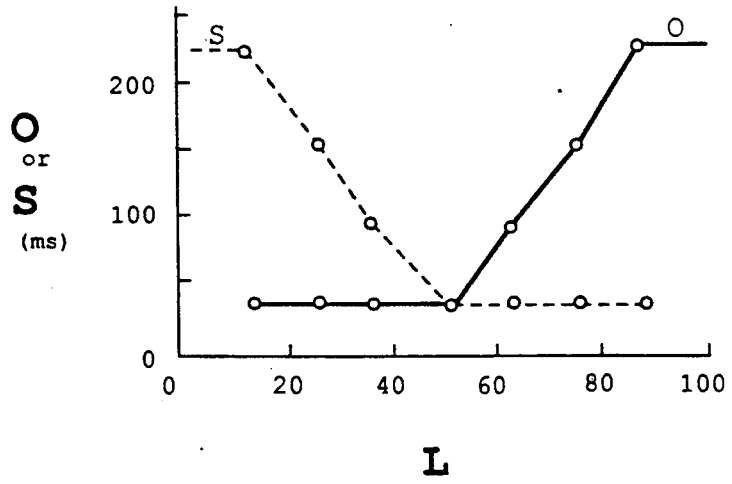
FIG. 5 shows part of the control conditions in accordance with the first embodiment of the invention.

The electronic control device 9 contains a program as schematically shown in FIG. 2. On the assumption that the conditions for execution of the feedback control of the air-fuel ratio by the subsidiary $O_2$ sensor 7 are satisfied, at step 41 the control device 9 determines whether or not a gating time has arrived, and if a gating time has arrived, the control operation proceeds to step 42. If a gating time has not yet arrived, the control operation proceeds to step 50. At step 42, it is determined whether or not the rich time period R exceeds a predetermined reference time period, and if the rich time period R exceeds the reference time period, the control proceeds to step 43. If the rich time period R does not exceed the reference time period, the control proceeds to step 46. At step 43, it is determined whether or not the air-fuel ratio at the previous gating time was rich, and if the ratio was rich, the control proceeds to step 44. If the ratio was not rich, however, the control proceeds to step 45. At step 44, as shown in FIG. 4, after the feedback control value L determined by the output voltage of the subsidiary $O_2$ sensor 7 is decreased by a predetermined value M, the control proceeds to step 49. At step 45, after the feedback control value L has been changed skippingly to the lean side of the stoichiometric air-fuel ratio by a value larger than the above-mentioned value M, the control proceeds to step 49. At step 46, it is determined whether or not the air-fuel ratio at the previous gating time was lean, and if the ratio was lean, the control proceeds to step 47. If the ratio was not lean, however, the control proceeds to step 48. At step 47, after the feedback control value L has been increased by a predetermined value N, the control proceeds to step 49. At step 48, after the feedback control value L has been changed skippingly to the rich side of the stoichiometric air-fuel ratio by a value larger than the above-mentioned value N, the control proceeds to step 49. At step 49, the rich time period R is cleared. At step 50, it is determined on the basis of the output voltage of the subsidiary $O_2$ sensor 7 whether or not the air-fuel ratio A/F is rich, and if the ratio is rich, the control proceeds to step 51, at which 1 (one) is added to the rich time period R.

The feedback control by the main $O_2$ sensor 6 and the subsidiary $O_2$ sensor 7 will now be described.

If all of the following conditions of the feedback control of the air-fuel ratio by the main $O_2$ sensor 6 are satisfied, the feedback control of the air-fuel ratio is performed in accordance with the output voltage of the main $O_2$ sensor 6. The abovementioned feedback control conditions are as follows:

(1) the engine coolant temperature is higher than 40° C.;

(2) the engine is not in a fuel-cut condition, such as in deceleration;

(3) the engine is not in an increased fuel (increased power) condition for increasing power in a high revolution range;

(4) a predetermined period of time has passed after the engine started;

(5) the main $O_2$ sensor has reached an activating temperature;

(6) the pressure sensor 3 is operating properly.

In particular, as shown in FIG. 3, if the output voltage of the main $O_2$ sensor 6 exceeds a reference level, after a rich delay time period 0 has passed, the air-fuel feedback correction coefficient I is reduced at first by a predetermined skip amount P and then gradually as shown at Q. As a result, the fuel amount supplied by the injector 1 is throttled, so that the air-fuel ratio of the mixture gas changes to the stoichiometric level. On the contrary, if the output voltage of the main $O_2$ sensor 6 becomes lower than the reference level, after a lean delay time periods has passed, the air-fuel feedback correction coefficient I is increased at first by a predetermined skip amount U and then gradually as shown at V. As a result, the amount of fuel supplied by the injector 1 is increased, so that the air-fuel ratio of the mixture gas changes to the stoichiometric level.

If the feedback conditions for the subsidiary $O_2$ sensor 7 are satisfied during the above-mentioned feedback control, a feedback control is conducted by the subsidiary $O_2$ sensor 7. The feedback conditions are, for example, as follows:

(1) a predetermined time period has passed after commencement of the feedback control of the air-fuel ratio by the main $O_2$ sensor 6;

(2) a predetermined time period has passed after the main $O_2$ sensor 6 reached the activating temperature;

(3) the engine coolant temperature is higher than 70° C.;

(4) the correction amount of fuel under a transient condition is lower than a predetermined level;

(5) the engine is in an idling state with the vehicle speed being zero (0), or the engine is in a non-idling state and in a predetermined running range.

Referring to FIG. 4, when the output voltage of the subsidiary $O_2$ sensor 7 exceeds a reference level, the rich time period R is counted up as shown by a serrated portion of the waveform R in the figure (step 50→step 51). If it is found at a gating time, say, $W_6$ that the rich time period R exceeds the reference time period, the feedback control value L is changed skippingly to the lean side (steps 41~43→step 45). If it is found at the next gating time $W_7$ that the rich time period R still exceeds the reference time period, the feedback control value L is reduced by a small amount M (steps 41~44). On the contrary, if it is found at a gating time, say, $W_3$ that the rich time period R does not exceed the reference time period, the feedback control value L is changed skippingly to the rich side (step 41→step 42→step 46→step 48). If it is found at the next gating time $W_4$ that the rich time period R does not exceed the reference time period, the feedback control value L is increased by a small amount N (step 41→step 42→step 46→step 47). In this manner the feedback control value L is changed, and on the basis of that value the rich delay time period 0 and the lean delay time period S are determined by the graph shown in FIG. 5. The larger the feedback control value L becomes, the longer the rich delay time period 0 becomes and the shorter the lean delay time period S becomes. As a result, the time at which the air-fuel ratio feedback correction coefficient I is switched from increasing to decreasing is delayed or the time at which the coefficient I is switched from decreasing to increasing is advanced, so that the amount of fuel to be supplied by the injector 1 is increased. On the contrary, if the feedback control value L is decreased, the amount of fuel to be supplied is decreased. The above-mentioned control is repeatedly conducted while the engine is running.

With this arrangement, while the feedback control of the air-fuel ratio is being conducted in accordance with the output voltage of the main $O_2$ sensor 6, as the average air-fuel ratio is shifted to either the rich side or the lean side, the feedback control value L determined by the output voltage of the subsidiary $O_2$ sensor 7 increases or decreases, so that the air-fuel ratio of the mixture gas is controlled rapidly and finely. In particular, when the output voltage of the subsidiary $O_2$ sensor 7 indicates a rich state, the feedback control value L is decreased skippingly on arrival of a gating time and the amount of fuel supply is accordingly decreased, so that the air-fuel ratio is rapidly shifted to the lean side. On the contrary, when the output voltage of the subsidiary $O_2$ sensor 7 indicates a lean state, the feedback control value L is increased skippingly on arrival of a gating time and the amount of fuel supply is accordingly increased, so that the air-fuel ratio is rapidly shifted to the rich side.

With the above arrangement, even when the output of the main $O_2$ sensor 6 is affected by individual differences in the output characteristics between different sensors, deterioration of its capacity caused by aging, fluctuation of the fuel injection amount of the injector 1, or the exhaust gas from a particular cylinder, so that a required air-fuel ratio control cannot be effected, the air-fuel feedback control by the subsidiary $0_2$ sensor 7 enables an effective control of the air-fuel ratio to the stoichiometric value.

Moreover, in accordance with the invention, when the output voltage of the subsidiary $O_2$ sensor 7 indicates a rich state, the air-fuel ratio is rapidly shifted to the lean side, while if the output voltage indicates a lean state, the air-fuel ratio is rapidly shifted to the rich side, so that the time period for which the air-fuel ratio remains rich and the time period for which the ratio remains lean can effectively be shortened. As a result, it is possible to eliminate the poisonous components in the exhaust gas by the three-way catalyst thereby to purify the exhaust gas efficiently.

The second embodiment of the invention will now be described. In the following embodiments the parts which correspond to those of the preceding embodiment are designated by the same symbols, and no explanation of those parts will be given.

Figure 6:
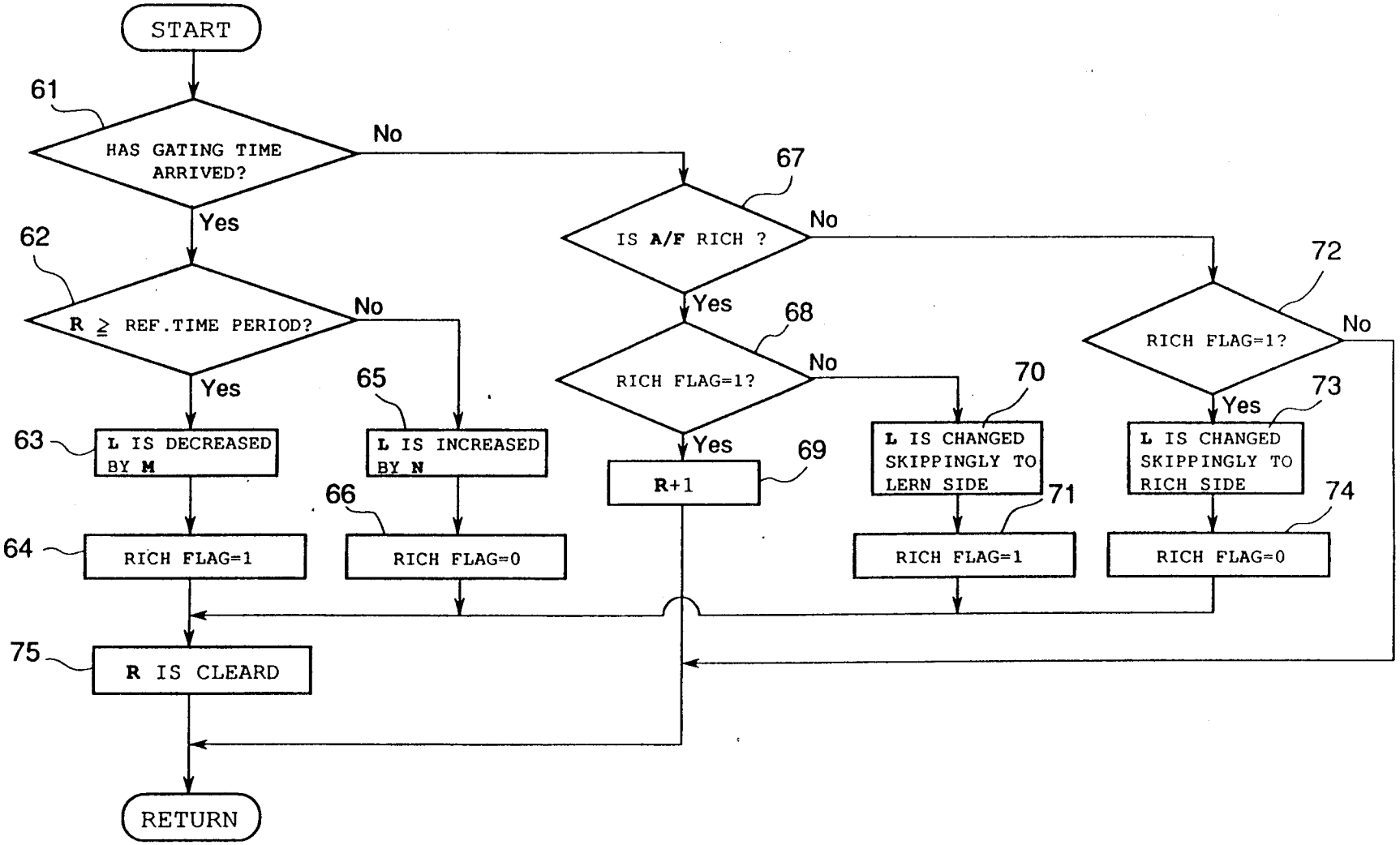
FIG. 6 is a flow chart showing the control steps in accordance with a second embodiment of the invention.

FIG. 6 schematically shows a part of the program contained in the electronic control device 9 for carrying out the embodiment. In this figure, on the assumption that the conditions for feedback control by the subsidiary $O_2$ sensor 7 are satisfied, at step 61 it is determined whether or not a gating time has arrived. If it is found that a gating time has arrived, the control proceeds to step 62. If not, the control proceeds to step 67. At step 62, it is determined whether or not the rich time R exceeds a reference time period. If it is found that the rich time period exceeds the reference time period, the control proceeds to step 63. If not, the control proceeds to step 65. At step 63, after the feedback control value L is decreased by a predetermined value M, the control proceeds to step 64. At step 64, a rich flag X is set to "1" indicating that the air-fuel ratio is rich, and the control proceeds to step 75. At step 65, after the feedback control value L is increased by a predetermined value N, the control proceeds to step 66. At step 66, the rich flag X is cleared, and the control proceeds to step 75.

At step 67, it is determined by the output voltage of the subsidiary $0_2$ sensor 7 whether or not the air-fuel ratio is rich. If it is found that the ratio is rich, the control proceeds to step 68. If not, the control proceeds to step 72. At step 68, it is determined whether or not the rich flag X is set to "1". If it is found that the rich flag X is "1", the control proceeds to step 69. If not, the control proceeds to step 70. At step 69, one (1) is added to the rich time period R. At step 70, after the feedback control value L is changed skippingly to the lean side by a value larger than the previously mentioned value M, the control proceeds to step 71. At step 71, the rich flag X is set to "1", and the control proceeds to step 75.

At step 72, it is determined whether or not the rich flag is set to "1". If it is found that the rich flag X is "1", the control proceeds to step 73. At step 73, after the feedback control value L is changed skippingly to the rich side by a value larger than the previously mentioned value N, the control proceeds to step 74. At step 74, the rich flag X is cleared, and the control proceeds to step 75. At step 75, the rich time period R is cleared.

Figure 7:
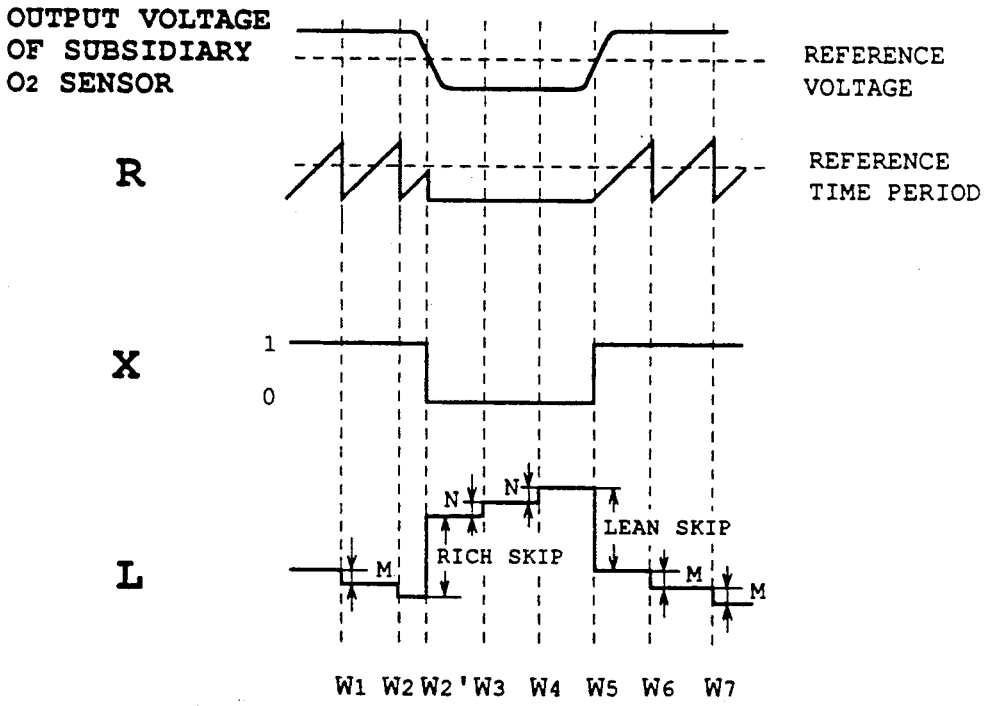
FIG. 7 is a timing chart showing a part of the control steps in accordance with the second embodiment of the invention.

As shown in FIG. 7, the air-fuel ratio feedback control utilizing the output voltage of the subsidiary $0_2$ sensor 7 is conducted in the following manner. First, if the output voltage of the subsidiary $0_2$ sensor 7 is above a reference level, the feedback control value L is decreased by a small value M at every gating time $W_1$, $W_2$ (or $W_6$, $W_7$) (steps 61~63). On the contrary, if the above-mentioned output voltage is below the reference level, the feedback control value L is increased by a small value N at every gating time $W_3$, $W_4$ (step 61→step 62→step 65). If the output voltage of the subsidiary $O_2$ sensor 7 becomes higher than the reference voltage and the air-fuel ratio was not rich at the previous gating time $W_4$, the feedback control value L is immediately decreased by a skip amount as at $W_5$ (step 61→step 67→step 86→step 70). If the output voltage of the subsidiary $0_2$ sensor 7 becomes lower than the reference voltage and the air-fuel ratio was rich at the previous gating time $W_2$, the feedback control value L is immediately changed skippingly to the increasing side as at $W_2'$ (step 61→step 67→step 72→step 73). In other words, when a change of the air-fuel ratio from the rich to the lean side is detected by the output voltage of the subsidiary $0_2$ sensor 7, the feedback control value L is immediately changed skippingly to the rich side even before a gating time is reached. In this manner the feedback control value L is changed, and the rich delay time period 0 and the lean delay time period S are determined in accordance with the changed control value. While the engine is running, the above control operation is repeatedly conducted, so that the amount of fuel supplied by the injector 1 is controlled properly in the above-mentioned manner.

In the above arrangement both the time period for which the air-fuel ratio of the total mixture gas is rich and the time period for which the ratio thereof is lean can effectively be shortened. When a change of the air-fuel ratio from the rich to the lean side is detected by the output voltage of the subsidiary $O_2$ sensor 7, the feedback control value L is immediately changed to the rich side even if the time for changing the value L has not yet been reached, so that the amount of fuel supplied by the injector 1 is quickly increased, thereby to adjust the air-fuel ratio to the stoichiometric level. Therefore, by the control method the air-fuel ratio can be quickly adjusted to near the stoichiometric level regardless of a control to be conducted at predetermined time intervals, so that the exhaust gas can be effectively purified by the three-way catalyst.

Figure 8:
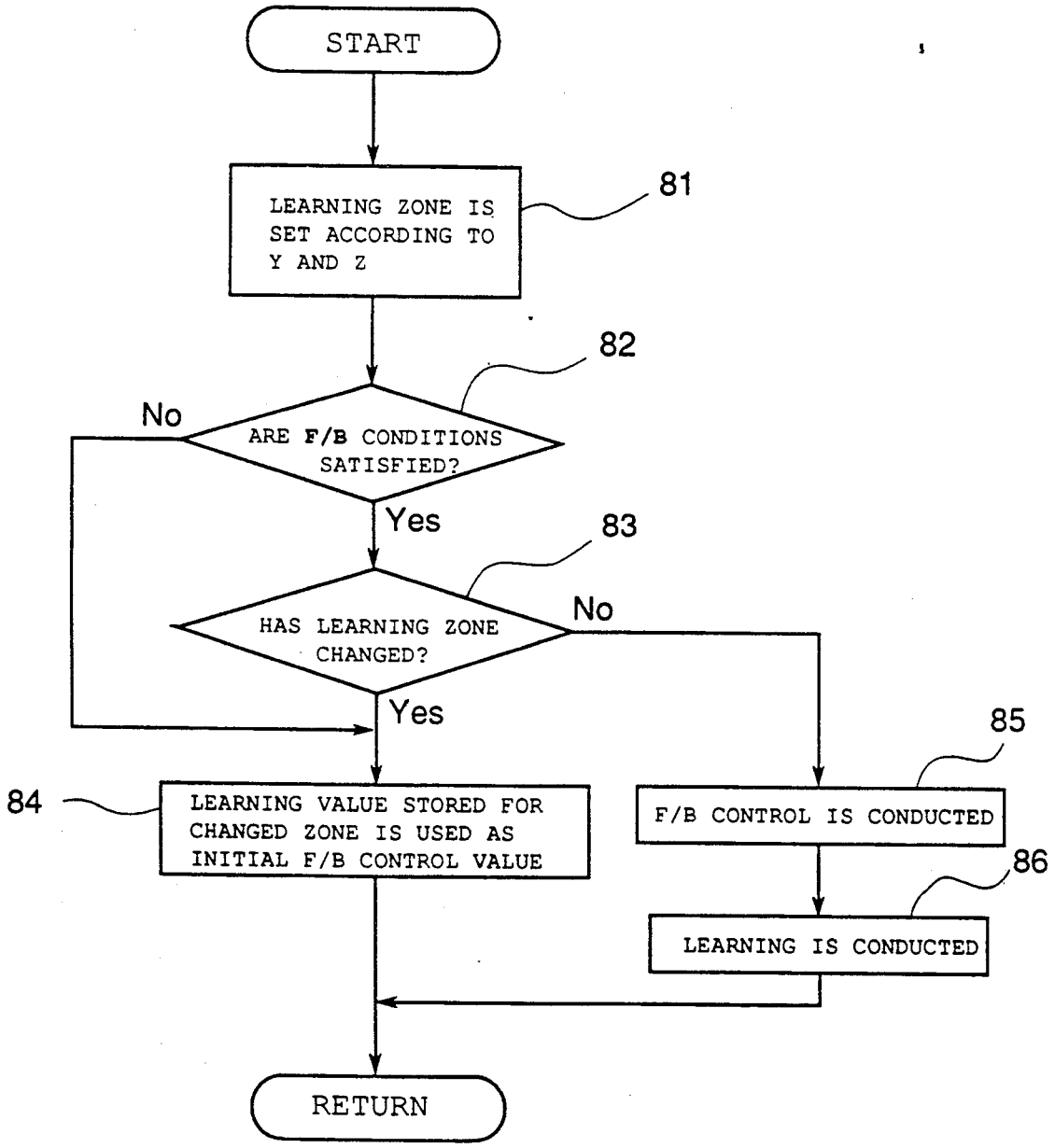
FIG. 8 is a flow chart showing the control steps in accordance with a third embodiment of the invention.
Figure 9:
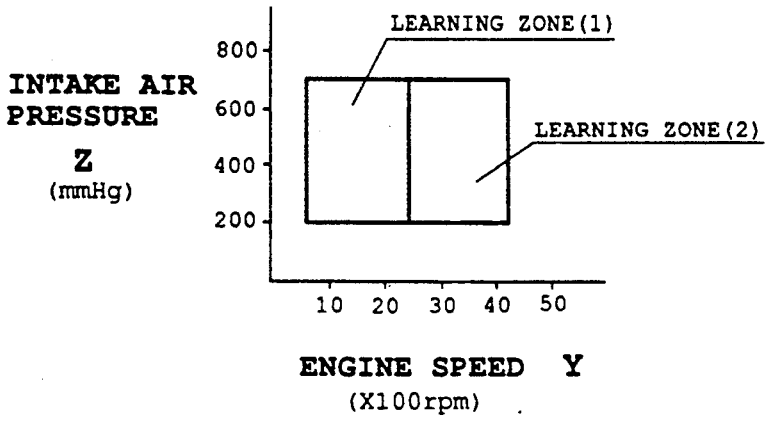
FIG. 9 shows learning zones provided for the feedback control value in the third embodiment of the invention.

FIGS. 8 through 11 show a third embodiment of the invention. In this embodiment a learning zone for the feedback control value is provided for each of the idling state and the non-idling state according to the engine speed and the intake air pressure. For the non-idling state the area for feedback control by the subsidiary $O_2$ sensor 7 is divided into a learning zone (1) and a learning zone (2) according to the engine load determined by the engine speed Y and the intake air pressure Z, as shown in FIG. 9. FIG. 8 shows a part of the program contained in the electronic control device 9 for carrying out the embodiment. At step 81, a learning zone is set according to the current engine speed Y and the intake air pressure Z, and the control proceeds to step 82. At step 82, it is determined whether or not the conditions for execution of feedback control by the subsidiary $0_2$ sensor 7 are satisfied. If it is found that the conditions are satisfied, the control proceeds to step 83. If not, the control proceeds to step 84. At step 83, it is determined whether or not the learning zone the current engine load belongs to has changed. If it is found that the zone has changed, the control proceeds to step 84. If not, the control proceeds to step 85. At step 84, the learning value stored beforehand for the changed learning zone is used as the initial value of the feedback control value L. At step 85, the feedback control of the air-fuel ratio by the subsidiary $O_2$ sensor 7 is conducted, and the control proceeds to step 86. At step 86, a mean value between a high (or relative maximum) value of the feedback control value L when it has changed from increasing to decreasing and a low (or relative minimum) value of the feedback control value L when it has changed from decreasing to increasing is obtained as a learning value.

Figure 10:
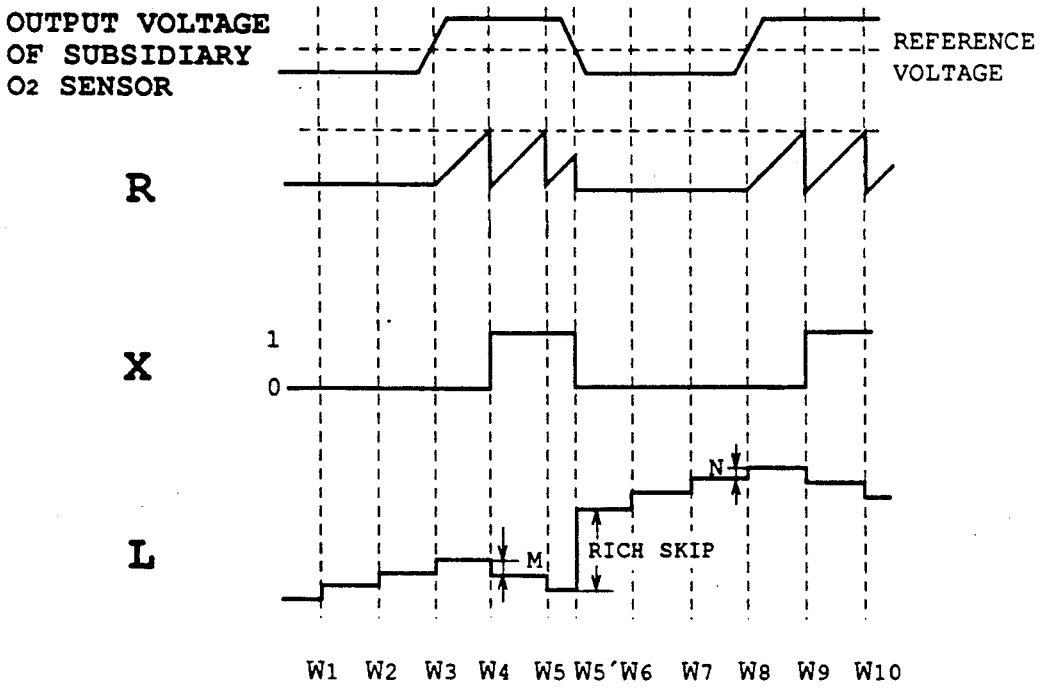
FIG. 10 is a timing chart showing a part of the control steps in accordance with the third embodiment of the invention.

The feedback control of the air-fuel ratio by the subsidiary $O_2$ sensor 7 is conducted normally at every predetermined gating time (e.g. every 40 msec) as shown in FIG. 10. If it is found by the output of the subsidiary $O_2$ sensor 7 that the air-fuel ratio has changed from the rich side to the lean side, the feedback control value L is immediately changed to the rich side. If the output voltage of the subsidiary $0_2$ sensor 7 exceeds a reference level, the rich time period R is counted up. If the learning zone has not changed and the rich time period R has been counted up to a predetermined value (at $W_4$, $W_9$), the rich flag X is set to "1" indicating a rich state, and the feedback control value L is decreased by a predetermined small value M. If the output voltage of the subsidiary $0_2$ sensor 7 becomes lower than the reference level (at $W_5'$) and the flag has been set to "0" indicating a lean state, the feedback control value L is increased by a predetermined skip amount and then successively by a predetermined small amount N. In this manner, the feedback control value L is changed, and a learning value of the feedback control value L is determined for the learning zone. The rich delay time period 0 and the lean delay time period S are determined in accordance with the feedback control value L, whereby the fuel injection amount from the injector 1 is adjusted in the above-mentioned manner.

Figure 11:
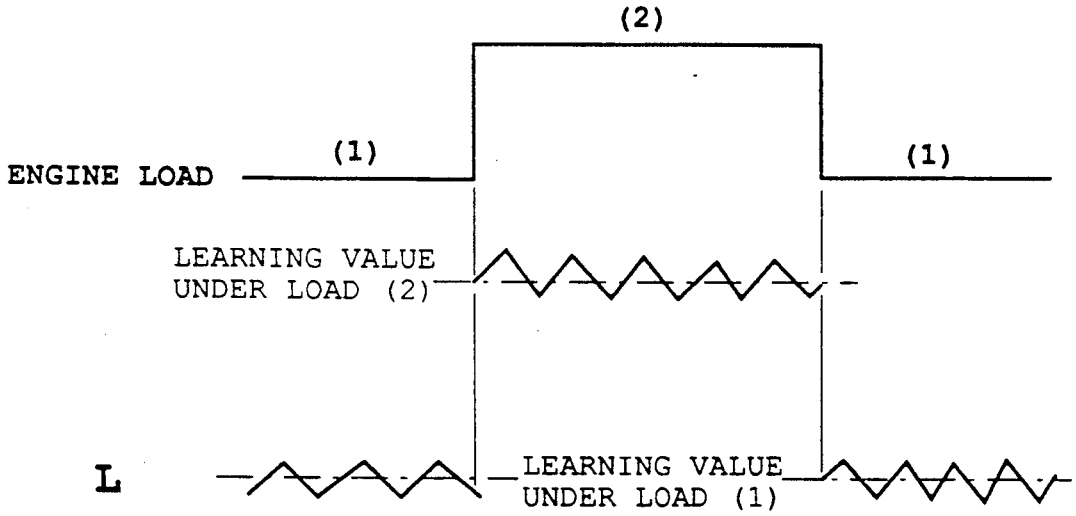
FIG. 11 shows the operation of the third embodiment of the invention.

In this embodiment, while the feedback control of the air-fuel ratio is being conducted in accordance with the output voltage of the main $O_2$ sensor 6, if the average air-fuel ratio of the mixture gas is shifted to the rich side or the lean side, the air-fuel ratio is adjusted finely in accordance with the output voltage of the subsidiary $0_2$ sensor 7. At the same time, learning is conducted on the feedback control value L in each learning zone, so that a learning value suitable for each of the engine loads (1) and (2) is determined as shown in FIG. 11. If the engine load is changed during feedback control of the air-fuel ratio by the main $0_2$ sensor 6, the air-fuel ratio feedback control is immediately taken over by the subsidiary $0_2$ sensor 7, with the learning value stored previously for the changed engine load as a starting point.

With this arrangement, even when the engine load is changed, the air-fuel ratio feedback control is conducted with a demanded value suitable for the engine load immediately after the load change, thereby to improve the response characteristic of the air-fuel ratio control. As a result, when the engine load is changed, the air-fuel ratio of the mixture gas can be adjusted to near the stoichiometric value, so that deterioration of the emission immediately after change of the engine load can be effectively prevented.

Figure 12:
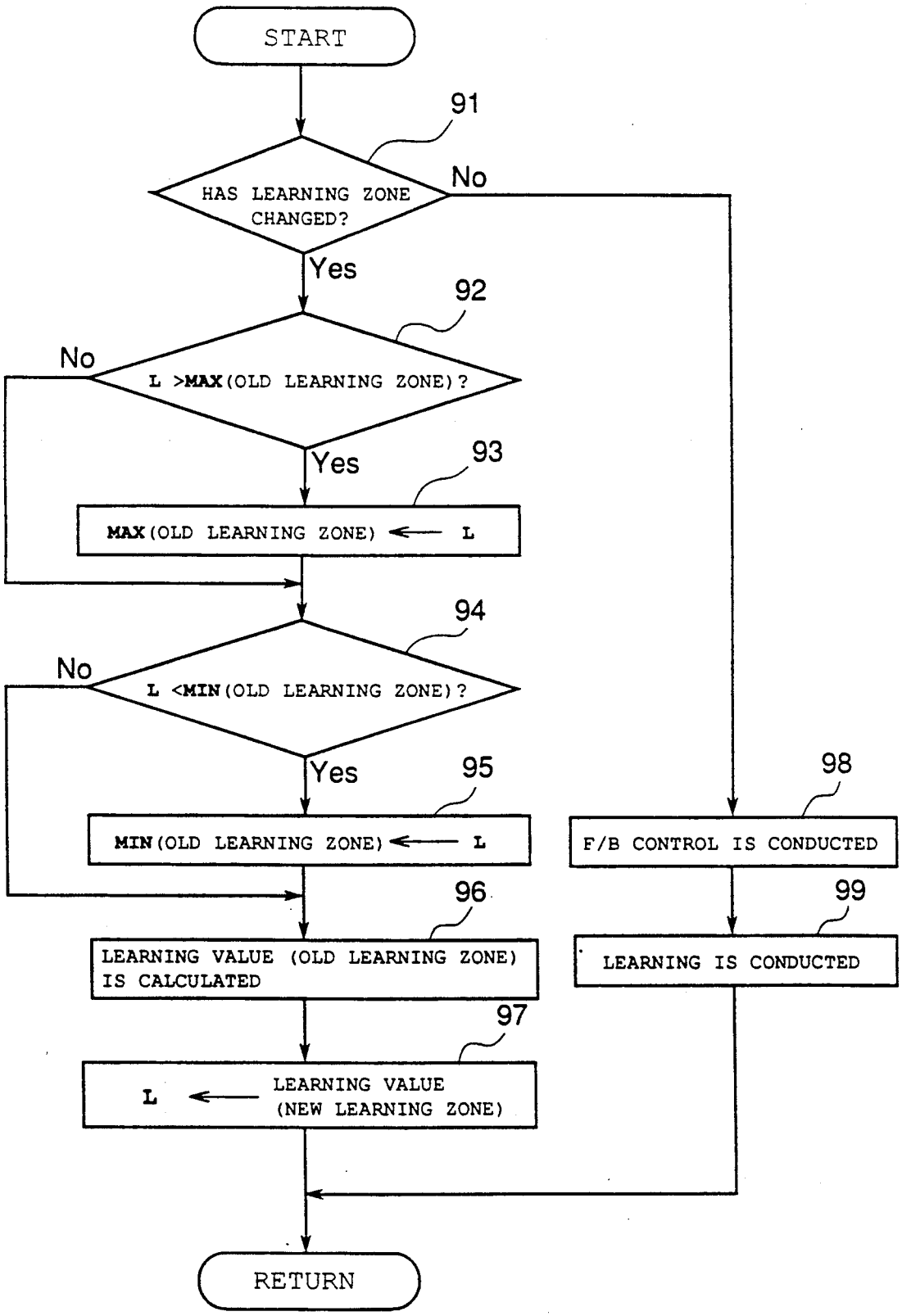
FIG. 12 is a flow chart showing the control steps in accordance with the fourth embodiment of the invention.
Figure 13:
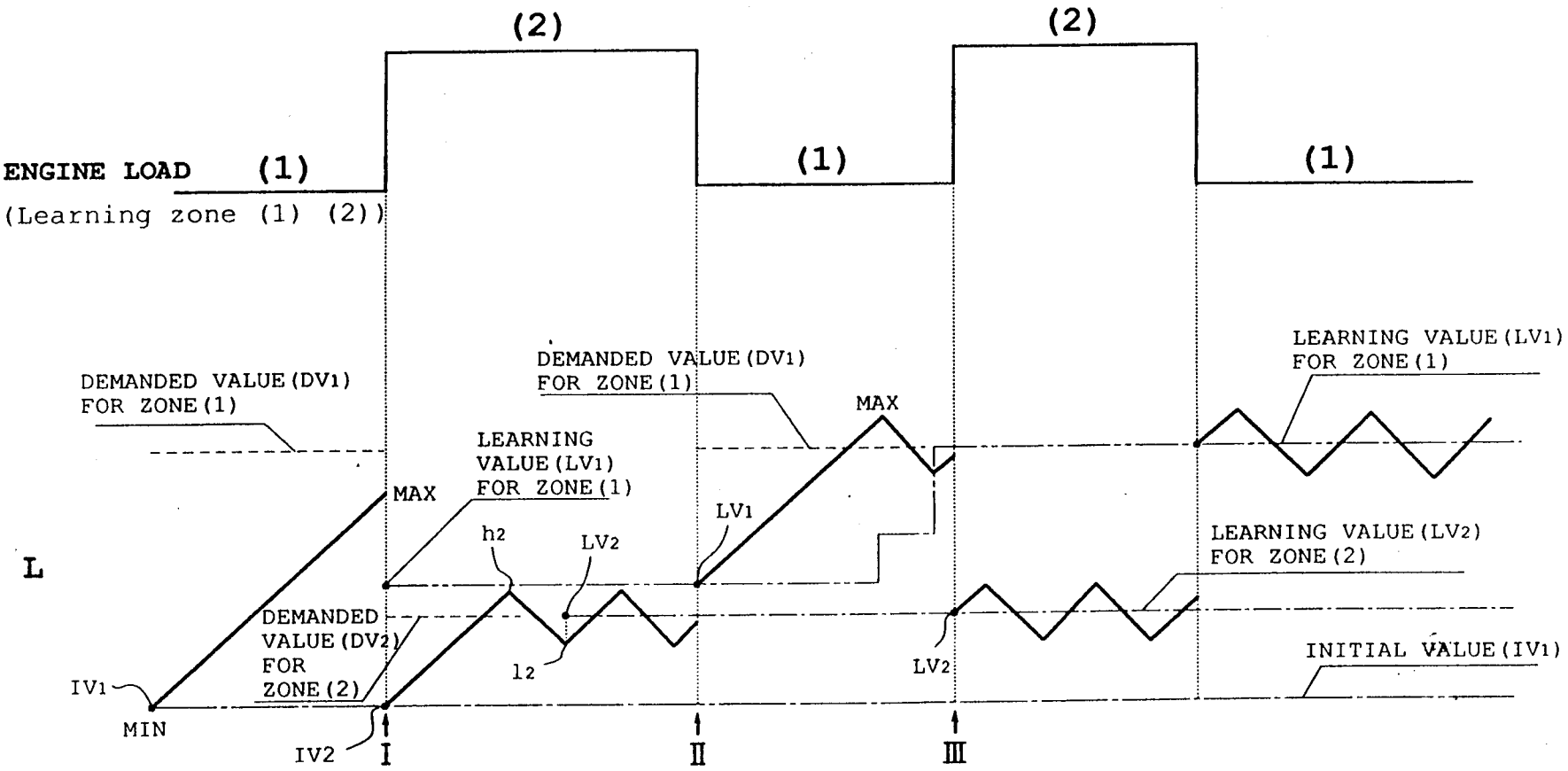
FIG. 13 shows the operation of the fourth embodiment of the invention.

FIGS. 12 and 13 show a fourth embodiment of the invention.

FIG. 12 shows a part of the program contained in the above-mentioned electronic control device 9 for carrying out the embodiment. At step 91, the current engine load is determined by the engine speed and the intake air pressure, and then it is determined whether or not the learning zone the current engine load belongs to has been changed. If it is found that the learning zone has been changed, the control proceeds to step 92. If it is found that the learning zone has not been changed, the control proceeds to step 98. At step 92, it is determined whether or not the feedback control value L at the moment the learning zone has been changed exceeds a value stored as the maximum of the feedback control value L in the previous learning zone (to be referred to as the old zone) the engine load belonged to immediately before the zone is changed. If it is found that the value L exceeds the stored previous maximum value, the control proceeds to step 93. If not, the control proceeds to step 94. At step 93, the feedback control value L at the moment the learning zone has been changed is adopted and stored as a new maximum value for the old zone, and the control proceeds to step 94. At step 94, it is determined whether or not the feedback control value L at the moment the learning zone has been changed is below a value stored as the minimum of the feedback control value L in the old learning zone. If it is found that the value is below the stored previous minimum value, the control proceeds to step 95. If not, the control proceeds to step 96. At step 95, the value L at the moment the learning zone has been changed is adopted and stored as a new minimum value for the old zone, and the control proceeds to step 96. At step 96, using the latest maximum and minimum values in the old zone a learning value is calculated and stored. Then the control proceeds to step 97. At step 97, the learning value for the learning zone (to be referred to as the new zone) to which the engine load now belongs is read out of a memory and adopted as a new feedback control value L. In other words, at this moment the feedback control value L is skippingly changed to conform to the learning value and held until feedback control is started the next time. At step 98, feedback control is conducted in accordance with the output voltage of the subsidiary $0_2$ sensor 7, and at the same time the feedback control value L is renewed, if and when necessary, and the control proceeds to step 99. At step 99, a learning value is calculated with the above-mentioned feedback control value L in the following manner. While feedback control is being conducted in accordance with steps 91, 98, 99 repeatedly at every predetermined cycle time, the feedback control value L is increased or decreased in the same manner as in the previously described embodiments. As the feedback control value L changes, a high (or relative maximum) value occurs when the value L changes from increasing to decreasing, and a low (or relative minimum) value occurs when the value L changes from decreasing to increasing, and the high stored and low values are replaced by new high and low values as they occur. At step 99, a learning value is calculated by taking the mean of the latest high and low values.

The feedback control by the subsidiary $\theta_2$ sensor 7 is conducted as shown in FIG. 10.

In this embodiment, as shown in FIG. 13, when the engine load is changed from a learning zone (1) to a learning zone (2) as at (I), if the initial value $IV_2$ of the feedback control value L and a demanded value $DV_2$ thereof in the learning zone (2) are relatively close to each other, the value L is changed from the initial value $IV_2$ to about the demanded value $DV_2$ in a short time, and in accordance with a high value $h_2$ and a low value $l_2$ of the value L changing about the demanded value $DV_2$ a learning value $LV_2$ for the zone (2) is determined. If the engine load is again changed from the zone (1) to the zone (2) later as at (III), the air-fuel ratio feedback control is immediately resumed with the above-mentioned learning value $LV_2$ as a starting point. On the other hand, in the zone (1) of the engine load with the initial value $IV_1$ of the feedback control value L and a demanded value $DV_1$ thereof being substantially apart from each other, it is likely that at the initial stage immediately after the feedback control is started from the initial feedback control value $IV_1$, the engine load changes to the zone (2) as at (I) without occurrence of a high (relative maximum) or a low (relative minimum) value of the feedback control value L. In that case, a learning value $LV_1$ for the zone (1) is calculated from the (absolute) maximum value MAX and the (absolute) minimum value MIN of the feedback control value L in the zone (1). If the engine load is again changed from the zone (2) to the zone (1) later as at (II), feedback control is conducted from the above-mentioned learning value $LV_1$ as a starting point.

The (absolute) maximum feedback control value MAX and the (absolute) minimum feedback control value MIN (which is equal to the initial value IV1 at first) in a learning zone, say, (1) of the engine load are determined at the moment (I) the engine load is changed from the zone (1) to the zone (2), and from the maximum and minimum values a learning value $LV_1$ for the zone (1) is calculated and stored (step 96 in FIG. 12). When the engine load is again changed from the zone (2) to the zone (1) later, as at (II), a feedback control in the zone (1) is conducted from the above-mentioned stored learning value $LV_1$ (step 97→start→step 98→step 99→). In FIG. 13, after the engine load is changed from the zone (2) to the zone (1) for a second time, as at (II), the feedback control value L reaches the demanded value $DV_1$ for the zone (1) during the period of time between (II) and (III) in which the engine load belongs to the zone (1) for a second time. If the value does not reach the demanded value $DV_1$ in the zone (1) for the second time, however, at the moment (III) the engine load has again changed from the zone (1) to the zone (2), a learning value for the zone (1) is calculated from the initial value IV2 as the minimum value and a new maximum value (which is higher than the above-mentioned maximum value MAX) in a similar manner to the above-mentioned case in which the engine load changed from the zone (1) to the zone (2) for the first time. As a result, the learning value in the learning zone (1) that the engine load belongs to gradually approaches the demanded value of the engine load in the zone (1). The next time the engine load is changed, feedback control is conducted from the learning value approaching the demanded value as a starting point.

According to this control method, even if the engine load is rapidly changed during feedback control of the air-fuel ratio, the air-fuel ratio can immediately be shifted to near the value required by the current engine load. As a result, when the engine load changes, the feedback control of the air-fuel ratio can be started from near the stoichiometric air-fuel ratio, so that the emission after the engine load has changed can effectively be improved. Even at the initial stage where there occurs neither high (relative maximum) nor low (relative minimum) value of the feedback control value, a learning value can be calculated from the (absolute) maximum value and the (absolute) minimum value. By renewing the learning value thus obtained the air-fuel ratio can be shifted to about the value required by the current engine load, so that the feedback control of the air-fuel ratio can be conducted from near the stoichiometric air-fuel ratio in spite of frequent changes of the engine load, thereby to effectively improve the emission when the load changes.

This invention is not limited to the above described embodiments. For example, in each of the above embodiments the rich delay time period and the lean delay time period of the feedback correction coefficient are changed in accordance with the feedback control value, and the amount of fuel supply is finely adjusted by the changed delay times. However, the basic injection amount may be corrected directly by the feedback control value, thereby to control the amount of fuel supply.

The rich skip amount or the lean skip amount of the feedback correction coefficient of the air-fuel ratio may be changed in accordance with the feedback control value. For example, in case the air-fuel ratio is lean and the feedback control value is controlled to the rich side, if the above-mentioned rich skip amount is made large and the lean skip amount is made small, the feedback correction coefficient is rapidly increased, so that the fuel supply amount is increased with resulting rapid adjustment of the air-fuel ratio to the stoichiometric value. In case the air-fuel ratio is rich, an inverse control is conducted.

In case the air-fuel ratio is lean, if the reduction factor (inclination) of Q in the feedback correction coefficient of the air-fuel ratio is made small, and the increasing factor (inclination) of V is made large in accordance with the feedback control value, the feedback correction coefficient is rapidly increased, so that the fuel supply amount is increased with resulting rapid adjustment of the air-fuel ratio to the stoichiometeric value. In case the air-fuel ratio is lean, an inverse control is conducted.

The learning zone of the feedback control value may be set more finely in accordance with the engine load.

The amount of intake air may be detected by an air flowmeter, etc.

We claim:

1. In a method of controlling an air-fuel ratio in an internal combustion engine having a catalyst converter for purifying exhaust gas of said engine and a first $O_2$ sensor and a second $O_2$ sensor disposed upstream and downstream, respectively, of said catalyst converter for detecting an oxygen concentration of said exhaust gas, and said method comprising the steps of:

feedback-controlling the air-fuel ratio of a mixture gas to be supplied to a combustion chamber of said engine to about a stoichiometric air-fuel ratio in accordance with an output voltage of said first $O_2$ sensor; and determining a feedback control value at predetermined gating times in accordance with an output voltage of said second $O_2$ sensor and shifting said air-fuel ratio to about said stoichiometric air-fuel ratio in accordance with said feedback control value;

the improvement comprising the steps of:

decreasing said feedback control value by a skip amount, upon arrival of a gating time, when a rich air-fuel ratio is detected by the output voltage of said second $O_2$ sensor; and increasing said feedback control value by a skip amount, upon arrival of a gating time, when a lean air-fuel ratio is detected by the output voltage of said second $O_2$ sensor.

2. In a method of controlling an air-fuel ratio in an internal combustion engine having a catalyst converter for purifying exhaust gas of said engine and a first $O_2$ sensor and a second $O_2$ sensor disposed upstream and downstream, respectively, of said catalyst converter for detecting an oxygen concentration of said exhaust gas, and said method comprising the steps of:

feedback-controlling the air-fuel ratio of a mixture gas to be supplied to a combustion chamber of said engine to about a stoichiometric air-fuel ratio in accordance with an output voltage of said first $O_2$ sensor; and determining a feedback control value at predetermined gating times in accordance with an output voltage of said second $O_2$ sensor and shifting said air-fuel ratio to about said stoichiometric air-fuel ratio in accordance with said feedback control value;

the improvement comprising the step of:

increasing said feedback control value of said air-fuel ratio by a skip amount to a rich side immediately when at least a lean air-fuel ratio is detected by the output voltage of said second $O_2$ sensor.

3. In a method of controlling an air-fuel ratio in an internal combustion engine having a catalyst converter for purifying exhaust gas of said engine and a first $O_2$ sensor and a second $O_2$ sensor disposed upstream and downstream, respectively, of said catalyst converter for detecting an oxygen concentration of said exhaust gas, and said method comprising the steps of:

feedback-controlling the air-fuel ratio of a mixture gas to be supplied to a combustion chamber of said engine to about a stoichiometric air-fuel ratio in accordance with an output voltage of said first $O_2$ sensor; and determining a feedback control value at predetermined gating times in accordance with an output voltage of said second $O_2$ sensor and shifting said air-fuel ratio to about said stoichiometric air-fuel ratio in accordance with said feedback control value;

the improvement comprising the steps of:

providing a plurality of learning zones corresponding to different engine loads;

determining a learning value of said feedback control value in each of said learning zones; and conducting feedback control of said air-fuel ratio with said learning value of another learning zone as a starting point when said engine load is changed from one learning zone to said other learning zone.

4. In a method of controlling an air-fuel ratio in an internal combustion engine having a catalyst converter for purifying exhaust gas of said engine and a first $O_2$ sensor and a second $O_2$ sensor disposed upstream and downstream, respectively, of said catalyst converter for detecting an oxygen concentration of said exhaust gas, comprising:

feedback-controlling the air-fuel ratio of a mixture gas to be supplied to a combustion chamber of said engine to about a stoichiometric air-fuel ratio in accordance with an output voltage of said first $O_2$ sensor; and determining a feedback control value at predetermined gating times in accordance with an output voltage of said second $O_2$ sensor and shifting said air-fuel ratio to about said stoichiometric air-fuel ratio in accordance with said feedback control value;

the improvement comprising the steps of:

providing a plurality of learning zones corresponding to different engine loads;

calculating a learning value in each of said learning zones from a high value of said feedback control value at a moment said value changes from increasing to decreasing and a low value of said feedback control value at a moment said value changes from decreasing to increasing, and calculating said learning value from maximum or minimum values of said feedback control value if respective high or low values thereof do not occur;

conducting feedback control of said air-fuel ratio with said learning value of said learning zone to which said changed engine load belongs as a starting point when said engine load is changed;

renewing said feedback control value as a new maximum value when said feedback control value at the moment said engine load has changed is greater than the maximum value thereof before the change of said engine load; and renewing said feedback control value as a new minimum value when said feedback control value at the moment said engine load has changed is smaller than the minimum value before the change of said engine load.

5. The improvement as in claim 2, and further comprising the step of:

decreasing the feedback control value of said air-fuel ratio by a skip amount to a lean side immediately when at least a rich air-fuel ratio is detected by the output voltage of said second $O_2$ sensor.

* * * * *